US006115011A

United States Patent [19]

Sano et al.

[11] Patent Number: 6,115,011

[45] Date of Patent: Sep. 5, 2000

[54] PLASMA DISPLAY DEVICE AND DRIVING METHOD

[75] Inventors: Yuji Sano, Zushi; Tadayoshi Oikawa, Yokosuka; Nobuo Azuma, Yokohama; Yuichiro Kimura, Yokohama; Masaji Ishigaki, Yokohama; Takashi Sasaki, Hiratsuka, all of Japan

[73] Assignee: Hitachi, Ltd., Tokyo, Japan

[21] Appl. No.: 08/868,142

[22] Filed: Jun. 3, 1997

[30] Foreign Application Priority Data

Jun. 6, 1996 [JP] Japan ..... 8-143958

[51] Int. Cl.[7] ..... G09G 3/28

[52] U.S. Cl. ..... 345/64; 345/63; 345/77

[58] Field of Search ..... 345/60, 63, 61, 345/64, 67, 77, 215; 315/169.1

[56] References Cited

U.S. PATENT DOCUMENTS

| | | | |
|---|---|---|---|
| 3,778,673 | 12/1973 | Eisenberg et al. | 345/63 |
| 4,020,280 | 4/1977 | Kaneko et al. | 348/797 |
| 4,140,945 | 2/1979 | Trogdon | 345/63 |
| 4,414,544 | 11/1983 | Suste | 345/63 |
| 4,924,148 | 5/1990 | Schwartz | 315/169.4 |
| 5,430,458 | 7/1995 | Weber | 345/60 |
| 5,446,344 | 8/1995 | Kanazawa | 315/169.4 |
| 5,483,252 | 1/1996 | Shigeta | 345/67 |
| 5,706,020 | 1/1998 | Iwama | 345/60 |
| 5,745,086 | 4/1998 | Weber | 345/63 |
| 5,757,343 | 5/1998 | Nagakubo | 345/63 |
| 5,790,087 | 8/1998 | Shigeta | 345/67 |
| 5,854,540 | 12/1998 | Matsumoto et al. | 315/169.1 |

FOREIGN PATENT DOCUMENTS

| | | |
|---|---|---|
| 0 657 861 A1 | 6/1995 | European Pat. Off. . |
| 61-98389 | 5/1988 | Japan . |
| 6-348227 | 12/1994 | Japan . |
| 7-044127 | 2/1995 | Japan . |

OTHER PUBLICATIONS

Shingaku Gihou EID92–86 (1993–01, pp 7–11).

*Primary Examiner*—William A. Cuchlinski, Jr.
*Assistant Examiner*—Marthe Y. Marc-Coleman
*Attorney, Agent, or Firm*—Antonelli, Terry, Stout & Kraus, LLP

[57] ABSTRACT

A plasma display device is capable of controlling the brightness of the entire image on a screen over a wide range without impairing a predetermined number of display gradations determined by the dynamic range of an A/D converter, an analogue input circuit and the like. For this purpose, the plasma display device is provided with means for changing the discharge condition (number of discharge pulses, discharge voltage, discharge voltage waveform and the like) during priming discharging, which is effected for initialization, in accordance with the brightness control to control the brightness of light emission during image display.

22 Claims, 7 Drawing Sheets

PLASMA DISPLAY DEVICE AND DRIVING METHOD

BACKGROUND OF THE INVENTION

The present invention relates to a plasma display device, and, more particularly, the invention relates to a plasma display device which is provided with means for enabling an image to be displayed with variable density in a predetermined number of display gradations on a screen, while enabling brightness control for the entire image without restricting the predetermined number of display gradations. The invention relates to a plasma display device for displaying an image on a screen by controlling the brightness and tone of the image, by means of, for example, a time sharing drive method, and by selectively illuminating pixels arranged in a matrix shape, and to a method of driving the device.

To provide an explanation of conventional brightness control in a matrix type plasma display device provided with means for enabling brightness control, a description will be made of the plasma display device shown in FIG. 2.

FIG. 2 is a block diagram of a plasma display panel (PDP) having a structure of the so-called "AC type". The plasma display device is composed of an analogue input circuit 10 to which an analogue video signal is inputted, an A/D converter 11, a data writing processing circuit 12, a frame memory 13, a data reading processing circuit 19, a display control circuit 15, a brightness control circuit 16, a plasma display panel 21, address electrodes 26, scanning electrodes 27 and sustaining electrodes 28, an address pulse output circuit 22 for driving the address electrodes 26, a scanning pulse output circuit 23 (used for both scanning and sustaining, but hereinafter, referred to as scanning pulse output circuit) for driving scanning electrodes 27, and a sustaining purse output circuit 25 for driving the sustaining electrodes 28.

An analogue video signal received at the input circuit 10 is converted into digital data by the A/D converter 11, and thereafter this data is written in the frame memory 13 through the data writing processing circuit 12. The data read out from the frame memory 13 is inputted to the address pulse output circuit 22 through the data reading processing circuit 14. The data which is converted into a plurality of bits by the A/D converter 11 is stored and processed in parallel when written in the frame memory 13, and the data is re-ordered in a single bit stream, in units of so-called bit frames for processing, when the data is read out from the frame memory 13. Each bit is allocated to a respective sub-field in accordance with a brightness weighting factor.

A pulse signal supplied to the address pulse output circuit 22, the scanning pulse output circuit 23 and the sustaining pulse output circuit 25 is produced by the display control circuit 15 on the basis of a vertical synchronizing signal. The brightness for the entire screen is controlled by controlling the analogue input circuit 10 using the brightness control circuit 16.

The plasma display panel 21 has two sheets of glass plates, address electrodes 26, scanning electrodes 27, sustaining electrodes 28, barrier ribs for partitioning the space between the glass plates, and the like. A pixel consists of a discharge cell which is formed in the space between the two streets of grass plates and is partitioned by barrier ribs.

The AC type plasma display panel is characterized in that the scanning electrodes 27 and the sustaining electrodes 28 are covered with dielectric layers. The discharge cell is charged with a rare gas, such as, for example, He—Xe and Ne—Xe, and when a voltage is applied between any pair of the address electrodes 26, scanning electrodes 27 and sustaining electrodes 28, a discharge occurs, generating ultraviolet rays. The barrier ribs are coated with a phosphor and are excised by ultraviolet rays to emit light. A color display can be generated by providing cells with luminous colors of phosphor, i.e. red, green or blue, for each discharge cell as a coating, to be selected in accordance with the image signal.

FIG. 3 shows an AC type plasma display drive waveform diagram. The electrode is driven in line sequence, and address pulses 51 at voltage VA are sequentially transmitted to address electrodes 26 corresponding to the discharge cells of the Nth row in response to the image signal. On the other hand, scanning pulses 52 at voltage VS are transmitted to the scanning electrodes 27 sequentially from the 1st line. In a cell for which the address voltage VA and the scanning voltage VS have been applied at the same time, the voltage between electrodes exceeds a discharge starting voltage for generating a discharge. This type of discharging is regarded as address discharging.

In order to stabilize the address discharging, a priming discharging period is usually provided before address discharging, wherein a voltage waveform, as shown in FIG. 3, is furnished to each electrode, and all cells are turned off after they are illuminated for a moment simultaneously to furnish a predetermined charge (hereinafter, referred to as a wall charge) on the dielectric layer covering the electrode, for initializing all of the cells. In a cell in which a discharge has occurred, charges are accumulated on the dielectric layer covering the electrode, and so as a discharge can be generated again at a lower voltage than the discharge starting voltage if initiated within a predetermined period thereafter. Such a driving method is called a "Memory driving method".

A time sharing drive method (hereinafter referred to as a sub-field method), using this memory driving method, will be described. The sub-field method operates to divide one field into a plurality of sub-fields on which weighting has been effected in accordance with differences in luminous brightness and to select any sub-field for each pixel in response to the magnitude of the applied signal to thereby produce a multi-tone display.

A drive sequence based on the time sharing drive method (sub-field method), as seen in FIG. 4, represents an example of a case where sixteen tones are displayed by means of four sub-fields SF1 to SF4. The scanning period (called an address period as well) 61 represents a period in which a luminescent cell is selected for the first sub-field, and the sustaining period 62 represents a period in which the selected cell emits light in response to a discharging generated between electrodes 27 and 28. The scanning period 61 includes the priming discharge period 63 and a period required to actually determine the address and select the luminescent cell. The priming discharging period 63 is a period required to initialize all the cells by first furnishing a predetermined wall charge on the electrodes on the entire screen.

The sustaining periods for sub-fields SF1 to SF4 are obtained by effecting weighting according to the brightness ratio of 8:4:2:1, and if these sub-fields are arbitrarily selected in response to the level of a video signal, a multi-tone display of the fourth power of 2=16 tones becomes possible. If the number of display gradations need to be increased, the number of sub-fields can be increased, so that, if the number of sub-fields is, for example, 8,256 tones can be displayed. The brightness level of each sub-field is controlled by the number of pulses.

The time sharing drive method, which is characterized by the fact that the scanning period 61 and the sustaining period 62 are thus completely separated from each other and a driving pulse common to all the screens is furnished concerning the sustaining period, is called an "Address display period separated driving method". As regards devices using a time sharing drive method of this type, refer to, for example, SHINGAKU GIHOU EID92-86 (1993-01, pp. 7–11).

SUMMARY OF THE INVENTION

In a plasma display device having a multi-tone display, brightness control (usually the black level, which is the minimum brightness on the screen, is controlled) for an image on the entire screen has conventionally been performed by changing the DC level of the analogue video signal received in the analogue input circuit 10 by means of the brightness control circuit 16, as shown in, for example, FIG. 2 and FIG. 5. In other words, as regards the adjustment the DC level of an analogue video signal inputted to the A/D converter 11 for brightness control, the black level moves up and down from a state a of brightness minimum to a state b of brightness maximum, as shown in FIG. 5.

Thus, the brightness has been controlled conventionally by controlling the DC level of the video signal. In the case of driving in a multi-tone display, however, when the DC level of the video signal is controlled, there arises a problem that the effective number of display gradations is undesirably affected by the brightness control. This problem will be exemplified by a case where a multi-tone display is produced by pulse number modulation, using FIG. 6 as an explanatory view for showing the dynamic range provided by conventional brightness control.

In order to effect pulse number modulation, a video signal is converted into a PCM signal by an A/D converter. When the DC level and amplitude of an input video signal supplied to this A/D converter are controlled, the following occurs. If the number of display gradations of a playback image displayed on a television screen is 256 tones, this can be generally considered to be sufficient in terms of image quality, and therefore, the description will be made with reference to an A/D converter having an output of eight bits. When the input dynamic range of this A/D converter is fully utilized from the minimum level to the maximum level, a PCM signal effective from the LSB (Least Significant Bit) of eight bits to the MSB (Most Significant Bit) can be obtained, thus enabling 256 tones to be displayed.

Referring to FIG. 6, in such an optimum state, that is, when eight bits of the A/D converter are allocated to the entire amplitude variation range (C in FIG. 6) of the video signal, the input dynamic range of the A/D converter, which had eight bits, as shown by A in FIG. 6 before the brightness is increased, decreases to a state shown by B when the brightness is increased by changing the DC level. Thus, when the video signal goes high, there arises a problem that the signal deviates from the input dynamic range to saturate the brightness, thus making it impossible to play back a normal screen.

If eight bits or less are allocated to the range C in FIG. 6, the number of display gradations of an image to be displayed decreases. The same applies to an amplifier and the like of an analogue input circuit having no room in the dynamic range. In order to avoid this, if the input dynamic range for the A/D converter is made to correspond to the DC level control range for a video signal, an A/D converter of high-bit number, such as 10 bits and 12 bits, must be used, i.e. the number of bits of the A/D converter has to be increased, and this leads to a problem that the A/D converter not only becomes expensive, but also the signal processing circuit becomes complicated with the increase in the number of bits, and also the power consumption increases. Further, decreased luminous brightness is also unavoidable due to the decreased sustaining period resulting from the increased scanning period.

An object of the present invention is to provide a plasma display device having means capable of effecting brightness control for the entire image on a screen in a wide range without undesirably affecting the predetermined number of display gradations determined by the dynamic range of the A/D converter, analogue input circuit and the like.

In order to achieve the above-described object, according to the present invention, there is provided means for changing the discharging condition, in accordance with the brightness control, for a priming discharge which is effected for initialization before the pixels are selected, making it possible to control the brightness of light emission due to the priming discharge irrespective of the input analogue circuit, thereby to control the brightness of the entire image on the screen. As to this discharging condition, it will suffice if the discharge voltage, the number of times of discharging (number of discharge pulses), the width of a discharge pulse, the discharge voltage waveform and the like to be applied to each electrode are controlled.

As another means for achieving the above-described object, according to the present invention, in addition to a conventional sub-field for producing a display in response to a video signal, there is provided, within one field, a period for causing all the cells exclusively used for brightness control to discharge, and there is also provided means for changing the discharging condition within a period for discharging all cells in accordance with the amount of brightness control, without depending upon control of the video signal level to change the amount of light emission caused by a discharge within the period for discharging all cells in accordance with the brightness control, thus making it possible to control the brightness of the entire screen. As to this discharging condition, it will suffice if the discharge voltage, the number of times of discharging (number of discharge pulses), the width of discharge period, the discharge voltage waveform and the like to be applied to each electrode likewise are controlled.

DETAILED DESCRIPTION OF THE PREFERRED EMBODIMENTS

A description will be made of various embodiments according to the present invention with reference to the drawings.

Figure 1:
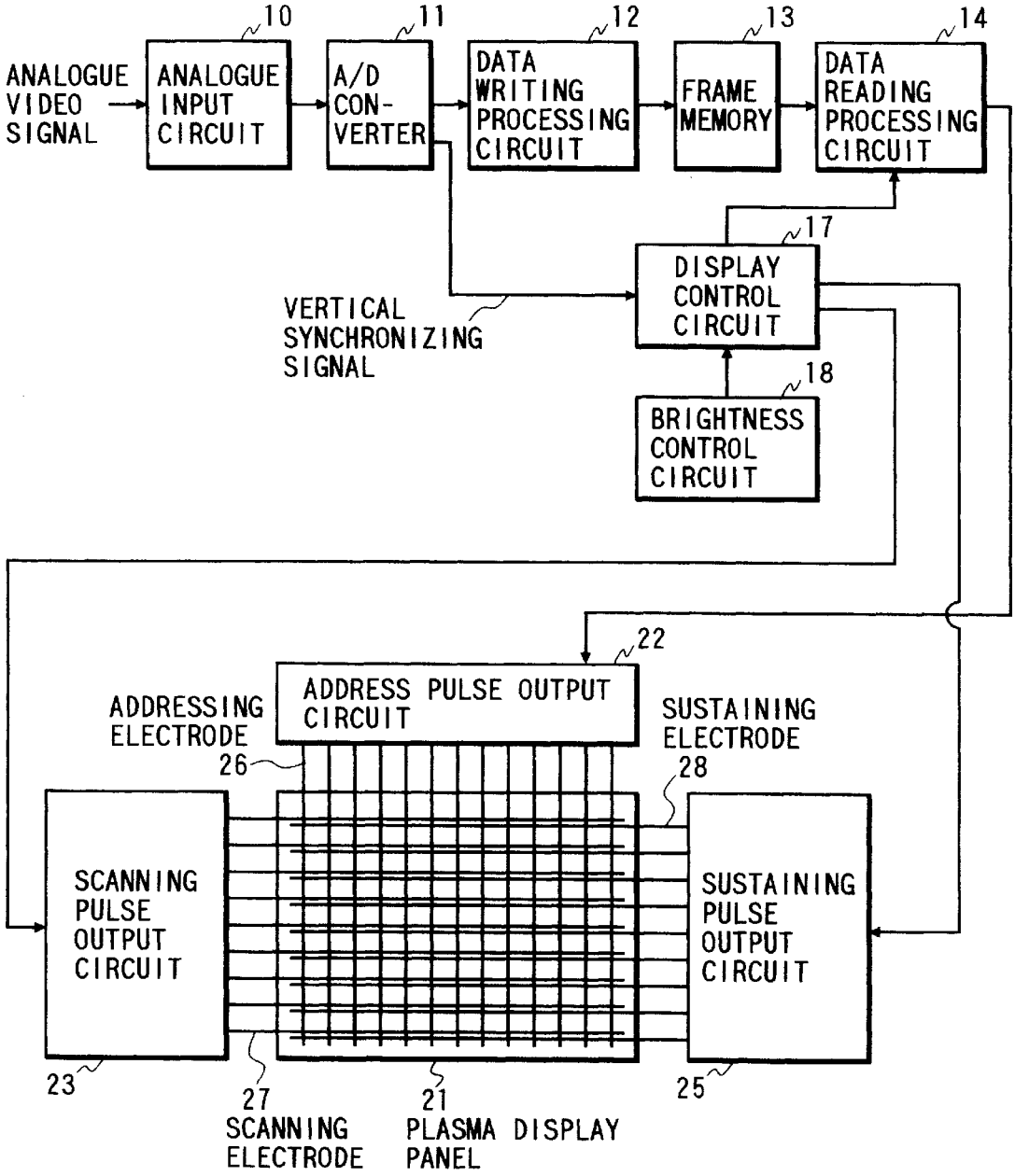
FIG. 1 is a block diagram showing a plasma display device according to a first embodiment of the present invention.
Figure 2:
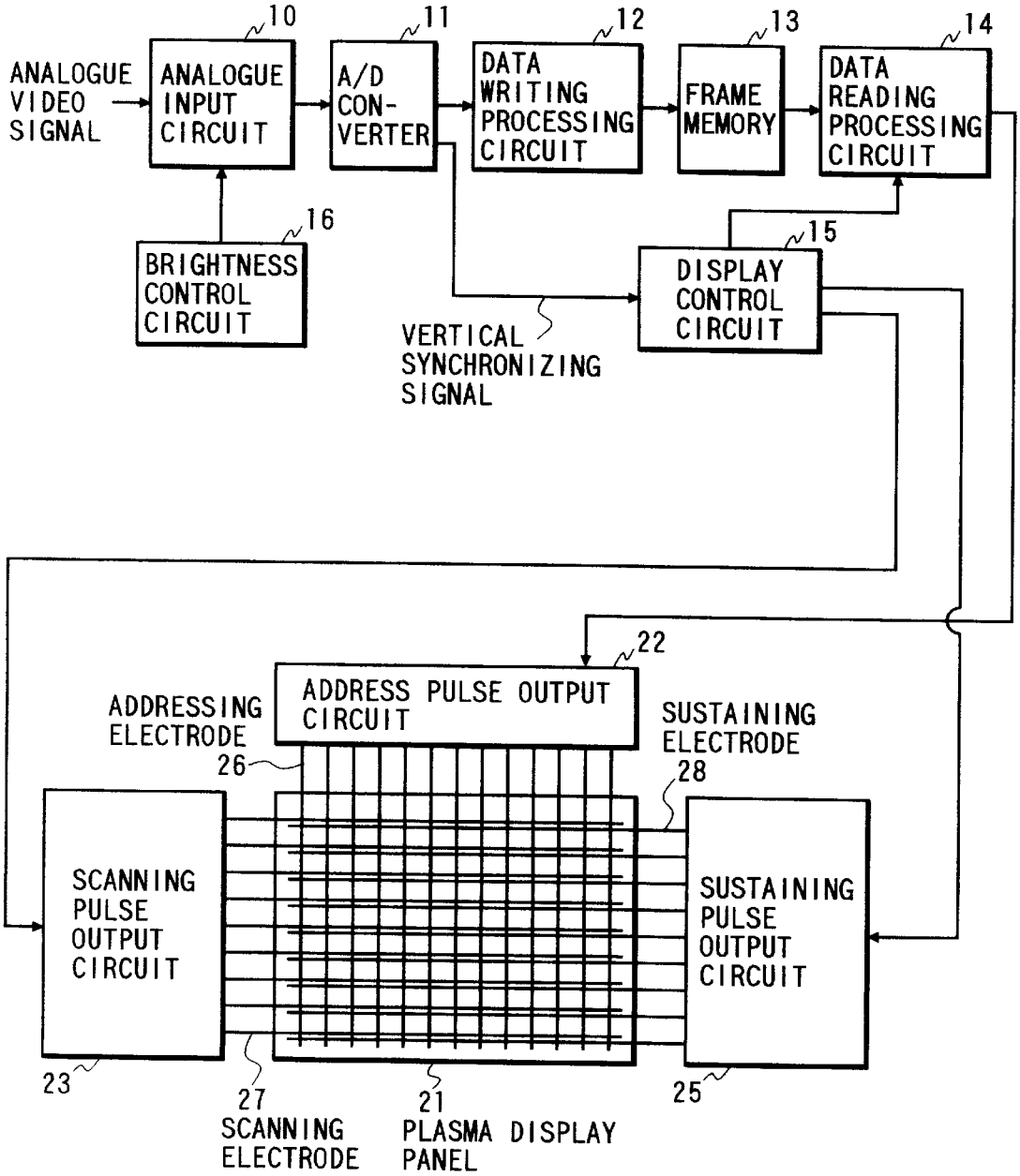
FIG. 2 is a block diagram showing a plasma display device for explaining conventional brightness control.
Figure 3:
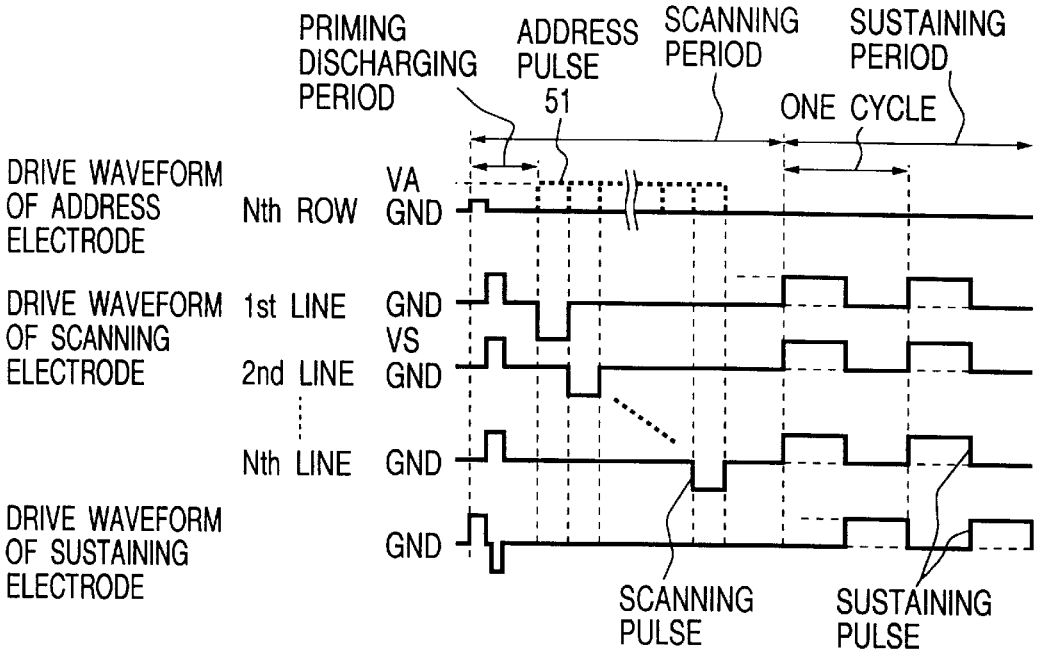
FIG. 3 is a plasma display driving waveform diagram.
Figure 4:
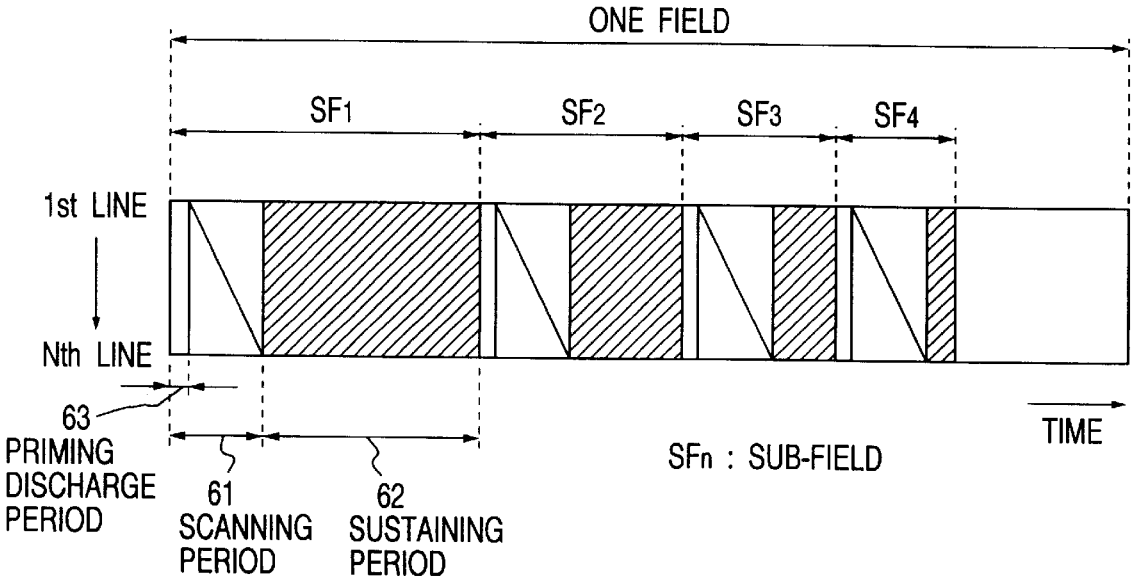
FIG. 4 is an explanatory diagram for showing a drive sequence based on a time sharing drive method.
Figure 5:
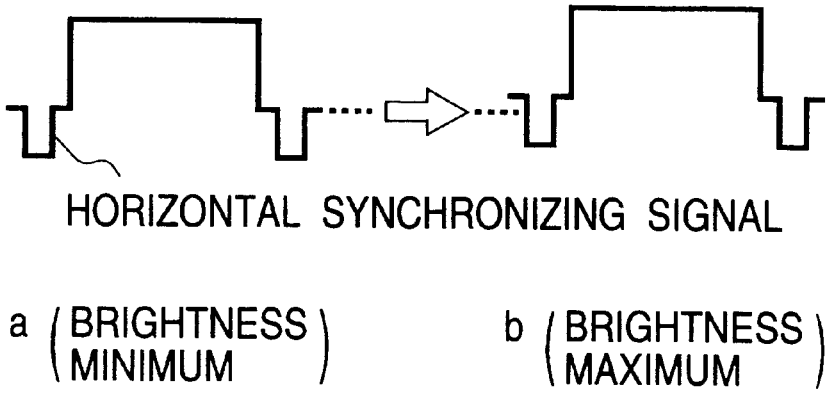
FIG. 5 is an explanatory diagram of an analogue video signal based on brightness control.

FIG. 1 is a block diagram showing a plasma display device according to a first embodiment of the present invention, and portions identical to those in the block diagram of FIG. 2 for a plasma display device for explaining conventional brightness control are designated by the same reference numerals or symbols. The major difference from FIG. 2 is that the brightness control circuit 18 is constructed so as to control the display control circuit 17.

A plasma display device according to the present invention is composed of an analogue input circuit 10 in which an analogue video signal is inputted, an A/D converter 11, a data writing processing circuit 12, a frame memory 13, a data reading processing circuit 14, a display control circuit 17, a brightness control circuit 18, a plasma display panel 21 having address electrodes 26, scanning electrodes 27 and sustaining electrodes 28, an address pulse output circuit 22 for driving the address electrodes 26, a scanning pulse output circuit 23 for driving the scanning electrodes 27 and a sustaining purse output circuit 25 for driving the sustaining electrodes 28.

An analogue video signal received by the input circuit 10 is converted into digital data by the A/D converter 11, and thereafter the data is written in the frame memory 13 through the data writing processing circuit 12. The data read out from the frame memory 13 is inputted to the address pulse output circuit 22 through the data reading processing circuit 14. The data converted into a plurality of bits by the A/D converter 11 is processed with each bit in parallel when they are written in the frame memory 13, and are processed a single bit at a time, in units of so-called bit frames for processing, when they are read out from the frame memory 13. Each bit is allocated to each sub-field in accordance with a brightness weighting factor.

A pulse signal supplied to the address pulse output circuit 22, the scanning pulse output circuit 23 and the sustaining pulse output circuit 25 is produced by the display control circuit 17 on the basis of a vertical synchronizing signal. The brightness of the black level on the entire screen is controlled by controlling the display control circuit 17, and not merely by the conventional approach of signal processing in the analogue input circuit 10 using the brightness control circuit 18, as explained with reference to FIG. 2.

The plasma display panel 21 has two sheets of glass plates, the addressing electrodes 26, the scanning electrodes 27, the sustaining electrodes 28, barrier ribs for partitioning the space sandwiched between the glass plates, and the like. It is the same construction as seen in FIG. 1 in which a pixel consists of a discharging cell which is formed in the space sandwiched between two sheets of grass plates and partitioned by barrier ribs.

Figure 7:
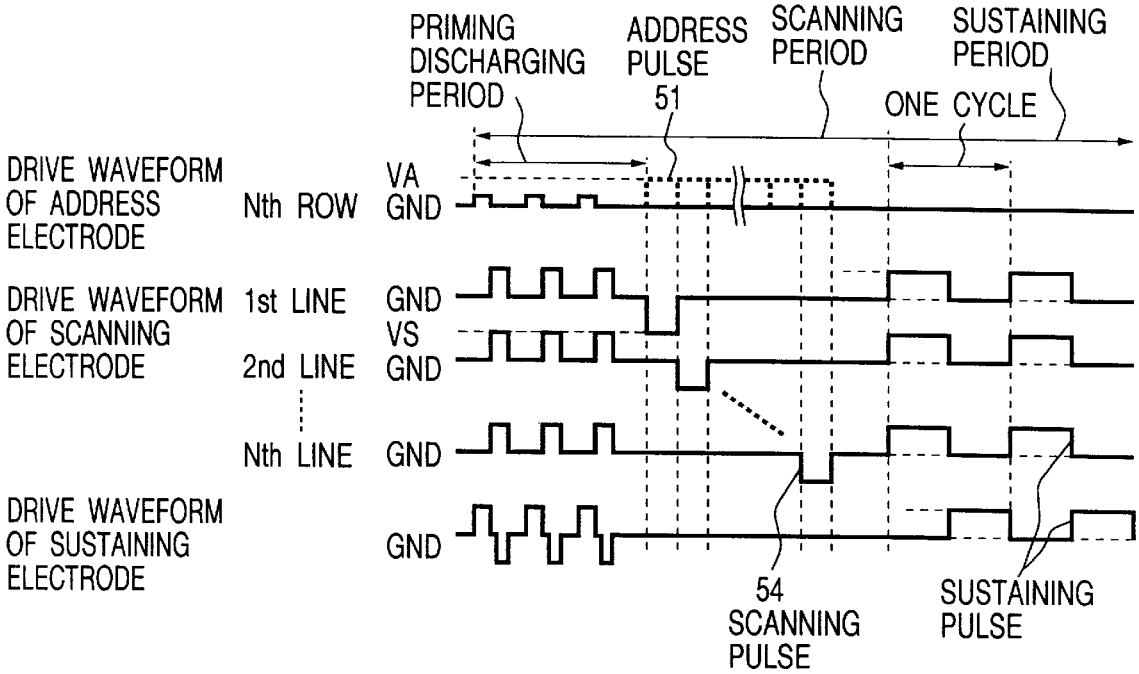
FIG. 7 is an explanatory diagram for showing the drive waveform of a plasma display according to the present invention.

FIG. 7 shows an AC type plasma display drive waveform according to the present invention. The electrode is driven in line sequence, and address pulses 51 at voltage VA are sequentially transmitted to addressing electrodes 26 corresponding to the discharging cells of the Nth row in response to the image signal in the scanning period. On the other hand, scanning pulses 54 at voltage VS are transmitted to the scanning electrodes 27 sequentially from the 1st line. In a cell for which the address voltage VA and the scanning voltage VS have been applied at the same time, the voltage between electrodes exceeds the discharge starting voltage for producing a discharge (address discharging).

In order to stabilize the address discharging, a priming discharging period is provided before address discharging, in which a voltage waveform as shown in FIG. 7 is furnished to each electrode, and all cells are turned off after they are illuminated once simultaneously to furnish a predetermined wall charge on the dielectric layer covering the electrode, for initializing all the cells.

According to the present invention, it is possible to control the brightness of the entire image on the screen by positively utilizing the light emission performed by the priming discharging at this time and by controlling the brightness of light emission in accordance with the brightness control. Conventionally, deteriorated contrast caused by priming discharging light has been a problem, but there are many cases where the brightness is actually increased when the external light is bright, and therefore, this priming discharging is utilized in an advantageous way in accordance with the present invention.

More specifically, there is provided means for changing the discharging condition for the priming discharging which is effected for initialization before the pixels are selected to control the brightness of light emission caused by the priming discharging. In accordance with the present embodiment, FIG. 7 shows a state in which priming discharging has been effected three times in the priming discharging portion of the scanning period. For example, it is possible to make the number of times priming discharging occurs in each sub-field variable from 10 times to once, or to increase the number of times priming discharging occurs to the maximum number sequentially from an appropriate sub-field. Also, referring to FIG. 7, the same number of drive waveforms are repeatedly applied to each electrode during priming discharging, but one part of a single drive waveform may be repeatedly applied to only a specified electrode. The present embodiment is characterized by the ability to digitally control the number of times light emission occurs in the priming discharging period in response to the brightness control.

More specifically, first a comparatively low voltage pulse (which may be zero) is applied as VA to all addressing electrodes, and at the same time, a positive, high voltage pulse is applied to the sustaining electrode for producing a first discharge. Thereafter, a positive, high voltage pulse is applied to the scanning electrode, and at the same time, a negative (or trailing) voltage pulse is applied to the sustaining electrode (zero at the addressing electrode) to ensure erasing of the priming discharge. This is repeated for a number of times required thereafter. In this respect, the DC level of GND may be either zero or a state in which a predetermined bias is applied.

By means of the time sharing drive method (sub-field method) using the memory driving method, one field is divided into a plurality of sub-fields on which weighting has been effected in terms of differences in luminous brightness, whereby any sub-field may be selected for each pixel in accordance with the amplitude of the signal, and a positive voltage pulse is alternately applied between the scanning electrode and the sustaining electrode during the sustaining period of FIG. 7 in the same sub-fields in which addressing has been completed to control the multi-tone display.

Figure 8:
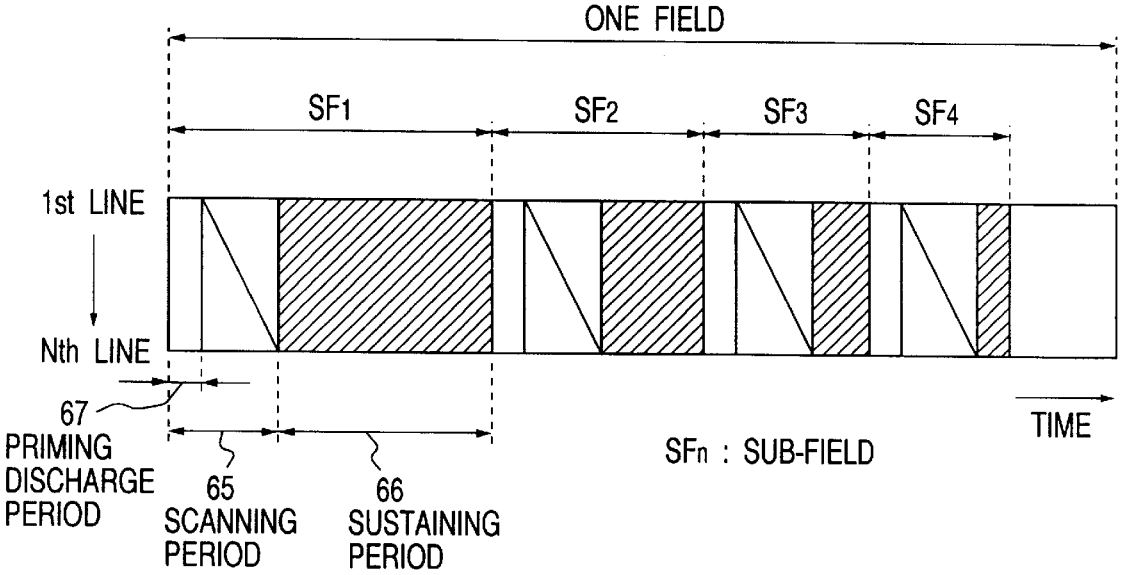
FIG. 8 is an explanatory diagram showing a drive sequence based on the time sharing drive method according to the present invention.

A drive sequence based on the time sharing drive method (sub-field method) is shown in FIG. 8 as an example of a case where sixteen tones are displayed by means of four sub-fields SF1 to SF4. The scanning period (address period) 65 represents a period required to select a luminescent cell for the first sub-field, and the sustaining period 66 represents a period in which the selected cell emits light. The scanning period 65 includes the priming discharging period 67 and an address (or scanning) period required to actually determine the address and select the luminescent cell. The priming discharging period 67 is a period required to initialize all cells by first producing a predetermined wall charge on the entire screen at the same time.

The sustaining periods for sub-fields SF1 to SF4 are obtained by effecting weighting on the brightness ratio of 8:4:2:1, and if these sub-fields are arbitrarily selected in accordance with the level of a video signal, a multi-tone display at the fourth power of 2=16 tones becomes possible. If the number of display gradations needs to be increased, the number of sub-fields can be increased, and if the number of sub-fields is, for example, 8, a display of 256 tones becomes possible. The brightness level of each sub-field is controlled by the number of pulses.

Figure 10:
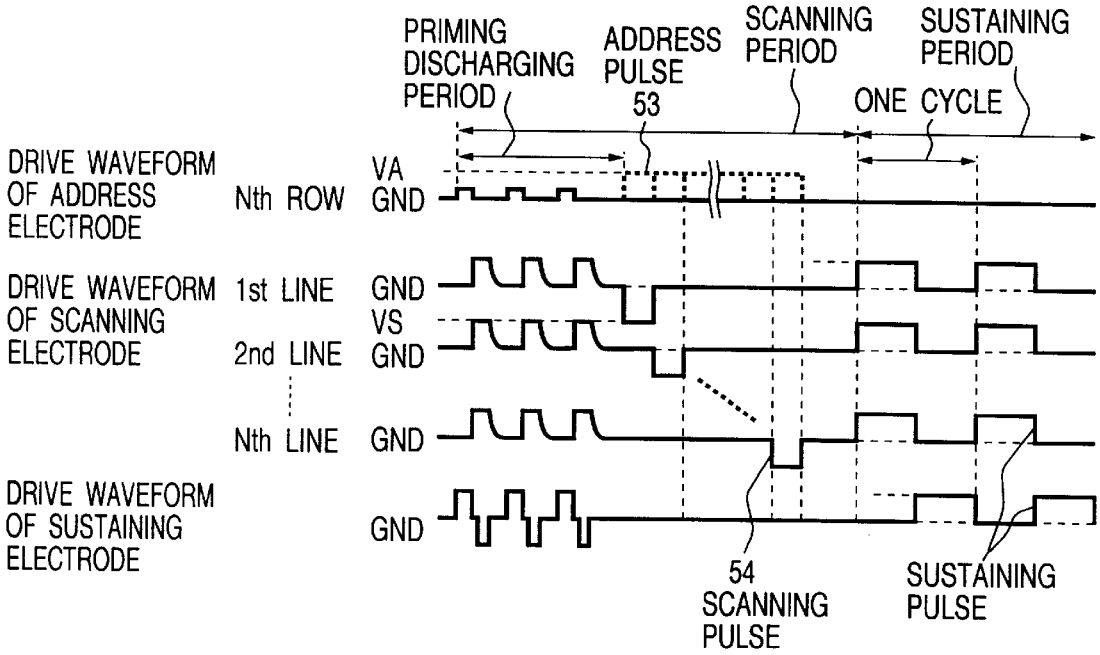
FIG. 10 is an explanatory diagram showing the drive waveform of a plasma display according to another embodiment.

In the priming discharging period 67 in the scanning period 65 of FIG. 8, priming discharging is effected three times as shown, for example, by the drive waveform of FIG. 10, and this is performed in at least one sub-field of each priming discharging period SF1, SF2, SF3 and SF4, thus obtaining an amount of light emission adapted to the brightness control. If the time interval of light emission for brightness control is made uniform by effecting control, for example, within only the priming discharging periods SF1 and SF3, it is possible to suppress the occurrence of pseudo-contour-shaped noise, which may be visually recognized during display of animation, together with the time sharing driving.

Figure 6:
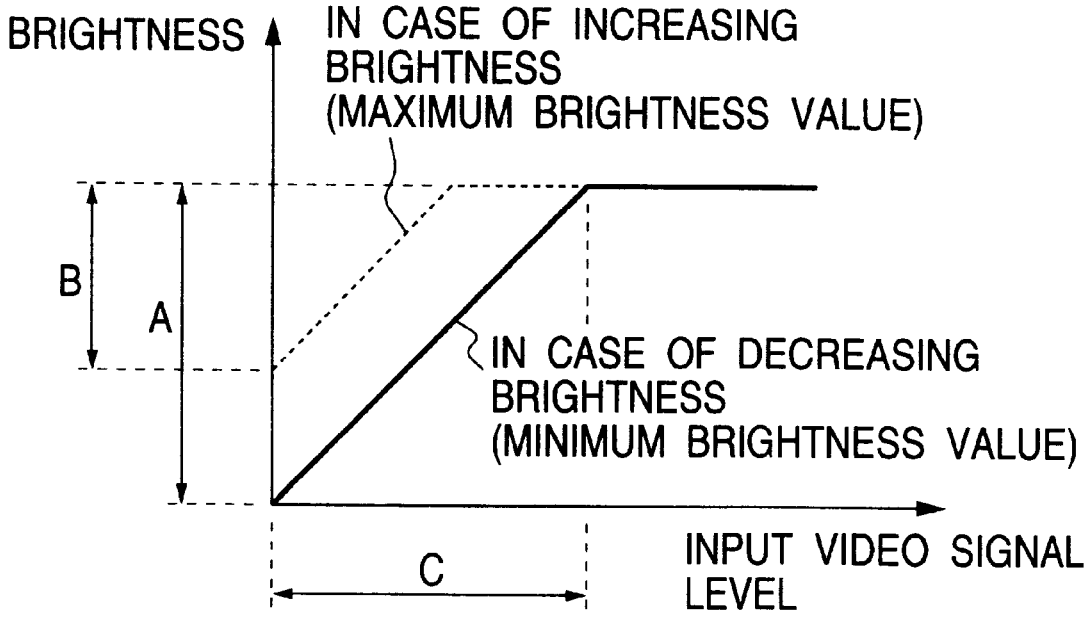
FIG. 6 is an explanatory diagram showing a dynamic range based on conventional brightness control.
Figure 9:
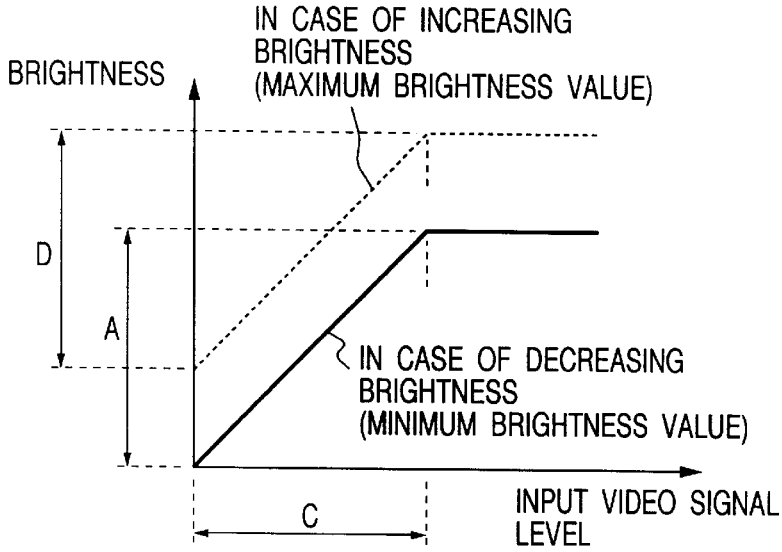
FIG. 9 is an explanatory diagram showing dynamic range based on brightness control according to the present invention.

By the use of the present invention, the priming discharging light enters a state in which it is raised by the brightness control, as shown in FIG. 9, and therefore, the DC level of a signal inputted into the A/D converter remains unchanged, and the dynamic range D in the analogue portion due to brightness control according to the present invention becomes the same as A of FIG. 6, thus making it possible to control the brightness of the entire image on the screen over a wide range without impairing the predetermined number of display gradations determined by the dynamic range.

The foregoing embodiment represents an example in which the numbers of times discharging occurs within the respective priming discharging periods SF1 to SF4 are simultaneously changed in response to the brightness control, but the present invention is not limited thereto. As a modified example of the above-described first embodiment, a second embodiment will be described.

As a second embodiment, it may be possible to change only the number of times discharging occurs within a specified discharging period, for example, the priming discharging period SF1, and to set the others to have discharging occur only once (usual priming discharging), or to combine them appropriately. One effect peculiar to use of such a combination is the possibility of reducing flicker by concentratedly effecting priming discharging for controlling brightness in a short period of, for example, the sustaining period, and the like.

The foregoing embodiments represent an example which involves changing a number of pulses produced in the display control circuit, and since it does not depend upon signal processing the input analogue circuit, there is the effect that the input dynamic range can be fully used and it becomes easy to effect digital control, to say nothing of the fact that the tone is not undesirably affected.

As a third embodiment, in contrast to the above-described examples, in which the number of times discharging occurs is changed, the pulse width applied to each electrode may be changed in accordance with the brightness control, with the number of pulses being a fixed number (for example, one) in FIG. 7, or the voltage value of the applied pulse may be changed in accordance with the brightness control. For example, the voltage applied to the sustaining electrode can be changed. In the case of changing the voltage value, there is the effect that the brightness can be controlled simply by means of an analog system with the digital circuit remaining as it is, to say nothing of the amount of control which can be selected continuously in non-stages.

There are various discharging conditions and, for example, the waveform (in, for example, FIG. 10, the shape of the slope shown is made steep or smooth by controlling the time constant of a circuit for generating a voltage pulse falling slope of the scanning electrode within a priming discharging period) of the priming discharging maybe changed in accordance with the brightness control.

Figure 11:
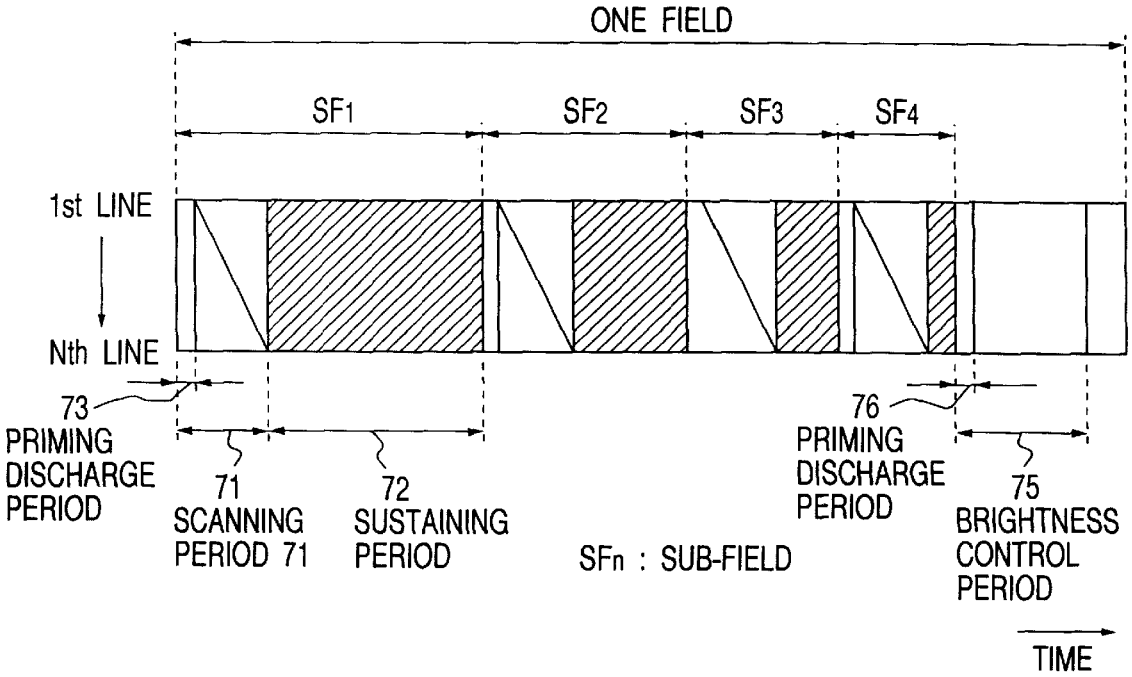
FIG. 11 is an explanatory diagram showing a drive sequence based on the time sharing drive method according to another embodiment.

The foregoing embodiments relate to examples in which the discharging condition of the priming discharge is changed in accordance with the brightness control, but a fourth embodiment, which is different from the previous embodiments, will be described using the drive sequence shown in of FIG. 11. In order to control the brightness of the entire image on a screen without impairing the predetermined number of display gradations determined by the dynamic range of the A/D converter, the analogue input circuit or the like, there is provided following the sub-field SF4, in the figure, a period (dedicated area, brightness control period 75 in the figure) for discharging all cells for exclusively controlling the brightness in addition to a sub-field for display in response to the video signal within one field. For this purpose, there is provided means for changing the discharging condition for a period (substantially a brightness control period, strictly speaking, a portion other than the priming discharging period 76) for discharging all cells in accordance with the brightness control, and the amount of light emission caused by such discharge within a period for discharging all cells in accordance with the brightness control can be changed to thereby control the brightness of the entire screen. At this time, it is needless to say that the number of sustaining discharging pulses within the brightness control period may be made variable.

Within this brightness control period 75, no scanning period is required, because all pixels can be selected. To this end, almost all periods are employed for sustaining discharging. Also, the priming discharging period 76 in the figure can be replaced with a simultaneous addressing period for all pixels to use a single pulse etc. Further, a discharging pulse exceeding the discharge starting voltage can be used within a period for sustaining discharging within the brightness control period, and the number of the pulses can be made variable to thereby delete the priming discharging period 76.

As the discharging condition, it will suffice if the number of times discharging occurs (number of discharging pulses), the width of the discharging pulse, the discharge voltage, the discharge voltage waveform and the like within a period corresponding to the sustaining period within the brightness control period, to be applied to each electrode, likewise are controlled. In this case, video signal areas (SF1 to SF4) for display are not used, but control can be performed independently exclusively for brightness, and therefore, it becomes easy to design the necessary control circuits and the like.

Various embodiments have been described above, and these can be appropriately combined for use as a matter of course. In a matrix display type plasma display device for selecting a number of pixels arranged in the horizontal and vertical directions for emitting light by applying a voltage to a plurality of electrodes arranged in a matrix shape, the effect of the present invention is to make it possible to control the brightness of the entire image on a screen over a wide range without impairing the predetermined number of display gradation determined by the dynamic range of the A/D converter, the analogue input circuit or the like, by applying a voltage to a plurality of electrodes arranged in a matrix shape.

What is claimed is:

1. A plasma display device of the matrix display type for displaying an image by selecting a number of pixels arranged in horizontal and vertical directions for emitting light by applying a voltage to a plurality of electrodes arranged in a matrix shape, comprising:

a changing part which changes a discharging condition for a priming discharging in which all cells of the plasma display device are substantially simultaneously discharged which is effected for initialization in accordance with a brightness control on selected pixels, the offset amount of a brightness level of the entire screen being controlled by changing an amount of light emission caused by the priming discharging in accordance with said brightness control.

2. A plasma display device as defined in claim 1, wherein said discharging condition is a number of times priming discharging occurs within a priming discharging period.

3. A plasma display device as defined in claim 2, wherein the number of times priming discharge occurs is greater than two.

4. A plasma display device as defined in claim 1, wherein said changing part operates only within a priming discharging period for at least one sub-field of a plurality of sub-fields.

5. A plasma display device as defined in claim 1, wherein said discharging condition is a voltage value of a priming discharging pulse applied within said priming discharging period.

6. A plasma display device as defined in claim 1, wherein said discharging condition is a pulse width of a priming discharging pulse applied within said priming discharging period.

7. A plasma display device as defined in claim 1, wherein said changing part changes the discharging condition for the priming discharging to enable an increase and decrease in brightness independent of an input image signal for said plasma display device.

8. A plasma display device as defined in claim 1, wherein said changing part changes said discharging condition to enable an increase brightness with respect to a brightness provided by a conventional plasma display device.

9. A plasma display device of the matrix display type for displaying an image by selecting a number of pixels arranged in horizontal and vertical directions for emitting light by applying a voltage to a plurality of electrodes arranged in a matrix shape, there being provided, within one field, a period for discharging all cells substantially simultaneously for exclusively controlling the brightness, in addition to a sub-field for displaying said image in plural tones in response to a video signal, comprising:

a part which changes a discharging condition within said period for discharging all cells substantially simultaneously in accordance with a brightness control, so that the amount of light emission caused by discharging within said period for discharging all cells substantially simultaneously in accordance with the brightness control is changed to thereby control an offset amount of the brightness level of the entire screen.

10. A plasma display device as defined in claim 6, wherein said discharging condition is a number of times of discharging occurs within said period for discharging all cells.

11. A plasma display device as defined in claim 10, wherein the number of times priming discharge occurs is greater than two.

12. A plasma display device as defined in claim 9, wherein said changing part changes the discharging condition within said period for discharging all cells to enable increase and decrease in brightness so that said offset amount of the brightness level of the entire screen is independent of an input image signal for said plasma display device.

13. A matrix display type plasma display device comprising:

a plurality of electrodes arranged in a matrix shape;

a plurality of cells arranged at intersections of said plurality of electrodes;

a brightness control circuit for controlling at least one of the number of pulses, the magnitude of said pulses or the pulse width of said pulses for driving said plurality of electrodes to change the luminous brightness of said plurality of cells; and a controller which controls a discharging condition for producing a priming discharging in said plurality of cells substantially simultaneously in accordance with the output of said brightness control circuit so as to change an amount of light emission caused by said priming discharging.

14. A matrix display type plasma display device as defined in claim 13, wherein said controller controls the discharging condition for producing the priming discharging in said cells to enable increase and decrease in brightness independent of an input image signal for said matrix display type plasma display device.

15. A matrix display type plasma display device as defined in claim 13, wherein said controller controls at least three pulses for controlling the discharging condition.

16. A method for driving a plasma display device of the matrix display type for displaying an image by selecting a number of pixels arranged in horizontal and vertical directions for emitting light by applying a voltage to a plurality of electrodes arranged in a matrix shape, wherein:

before said pixels are selected, an amount of light emission caused by priming discharging in which all cells of the plasma display device are substantially simultaneously discharged is changed by controlling the discharging condition for priming discharging, which is effected for initialization, in accordance with a brightness control.

17. A method for driving a plasma display device as defined in claim 16, wherein said discharging condition is a number of times priming discharging occurs within a priming discharging period.

18. A method as defined in claim 17, wherein the number of times priming discharge occurs is greater than two.

19. A method for driving a plasma display device as defined in claim 16, wherein said changing part operates only within a priming discharging period in at least one sub-field of a plurality of sub-fields.

20. A method for driving a plasma display device as defined in claim 16, wherein said discharging condition is a voltage value for a priming discharging pulse within said priming discharging period.

21. A method for driving a plasma display device as defined in claim 16, wherein said discharging condition is a pulse width for a priming discharging pulse within said priming discharging period.

22. A method as defined in claim 16, wherein the discharging condition for priming discharging is controlled to enable increase and decrease in brightness independent of an input image signal for said plasma display device.

* * * * *